United States Patent [19]

Fulton

[11] Patent Number: 4,867,159

[45] Date of Patent: Sep. 19, 1989

[54] BABY PACIFIER

[76] Inventor: William R. Fulton, 401 Lake Crest Dr., Spartanburg, S.C. 29301

[21] Appl. No.: 220,566

[22] Filed: Jul. 18, 1988

[51] Int. Cl.[4] ..... A61J 17/00

[52] U.S. Cl. ..... 128/360; 128/359

[58] Field of Search ..... 128/359, 360; 604/71, 604/212; 215/11 R; D24/46, 45, 47

[56] References Cited

U.S. PATENT DOCUMENTS

| | | | |
|---|---|---|---|
| 3,610,248 | 10/1971 | Davidson | D24/46 |
| 4,329,996 | 5/1982 | Copeland | 128/359 |
| 4,381,785 | 5/1983 | Robbins | 128/360 |
| 4,481,949 | 11/1984 | Kesselring et al. | 128/360 |
| 4,768,510 | 9/1988 | Leung | 128/360 |

FOREIGN PATENT DOCUMENTS

| | | | |
|---|---|---|---|
| 2466245 | 4/1981 | France | 128/360 |

*Primary Examiner*—Michael H. Thaler

*Assistant Examiner*—William Lewis

*Attorney, Agent, or Firm*—Dority & Manning

[57] ABSTRACT

An improved baby pacifier including a fillable reuseable nipple, a handle, and a cover that locks into place with a tilt, snap and twist motion. The pacifier includes a sealing plug to removably secure the nipple to the main body and seal the nipple filling inside the nipple. The main body of the pacifier includes a mating flange which extends outwardly from the outer surface of the main body about the entire circumference except for a discontinuous portion which forms a gap. The cover includes bosses on its interior surface to matingly engage the mating flange on the main body so as to secure engagement of the cover to the main body and prevent a child from removing it. The pacifier further includes a shield extending from the outer surface of the pacifier and including safety holes to prevent asphyxiation in the event the pacifier is swallowed.

7 Claims, 1 Drawing Sheet

BABY PACIFIER

BACKGROUND OF THE INVENTION

This invention relates to an improved baby pacifier. More particularly, the present invention relates to an improved baby pacifier which includes a fillable reuseable nipple, a ring handle, and a cover, which locks into place with a tilt, snap and twist motion.

It is known to provide a pacifier which includes a main body portion whose inner surface forms a cavity and whose outer surface includes conventional screw threads. It is also known for this pacifier to include a non-refillable jelly filled nipple with an open flanged end which extends through the cavity and whose open-end flange is secured by a plug within an opening in an end wall formed on one end by the inner surface of the main body. The plug includes a shaft with a truncated spherical nub at one end and a flange at the other end. The nub extends through the flange of the nipple and secures it against the end wall of the main body. The flange of the plug rests on a ledge formed by the inner surface of the main body near the opposite end of the cavity. The pacifier further includes a cover which is open on one end and has conventional screw threads on the interior surface of the open end and which is adapted to be screwed onto the exterior of one end of the main body to serve as a cover and to be screwed onto the other end of the main body to serve as a handle for the pacifier. The main body further includes an annular skirt which extends outwardly from a central region of the exterior surface. It is known to provide anti-choking holes through the skirt to provide for passage of air in the event that the skirt becomes lodged in a child's air passage. The skirt extends out an equal distance about the circumference of the main body and is curved in a direction away from the end of the main body through which the nipple protrudes.

The above-described pacifier is not reuseable after the fluid has been extracted from the nipple. Further, the conventional screw type attachment of the handle to the main body allows the handle to be easily removed by the child and thereby increases the possibility of the child swallowing the pacifier or the handle. In addition, the chance of the pacifier being swallowed by the child is increased by the shield extending equidistantly about the circumference of the main body and curving away from the child's mouth when the pacifier is in use.

OBJECTS AND SUMMARY OF THE INVENTION

It is an object of the present invention to provide an improved baby pacifier.

It is also an object of the present invention to provide a clean and safe baby pacifier.

It is a further object of the present invention to provide a compact pacifier with a cover for the nipple.

It is a further object of the present invention to provide a pacifier with an easily removable reuseable nipple.

Yet another object of the present invention is to provide a pacifier with a reuseable nipple that can be refilled any number of times with a liquid or jelly substance to be ingested by a baby.

Another object of the present invention is to provide a pacifier whose cover is not easily removable by children.

A further object of the present invention is to provide a baby pacifier with an improved locking mechanism to secure the cover to the main body of the pacifier.

Yet another object of the present invention is to provide a pacifier shaped so as to be difficult to swallow by a child.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects, and in accordance with the purpose of the invention, as embodied and broadly described herein, the improved baby pacifier of this invention comprises a main body having an integral side wall. The side wall has an interior surface defining a cavity. The cavity has a first opening at one end thereof and a second opening at a second end disposed opposite the one end. The main body defines an end wall at the one end, the end wall defining an opening therethrough. The interior surface of the side wall defines a sealing ledge at the second end of the cavity.

The pacifier further includes a hollow elongated cover open at only one end thereof. The outer surface of the cover preferably includes gripping ribs to facilitate secure grasping of the cover. The cover has means for securing the cover to the main body. The securing means preferably includes at least three connecting bosses disposed inside the cover at the open end, with one of the bosses being solitary and disposed generally opposite the others.

The pacifier further includes means for the baby to suck. The sucking means preferably includes a hollow flexible nipple open at only one end into a receiving cavity and forming a flared flange at the open end and having a liquid permeable portion disposed opposite the open end. Preferably, the permeable portion defines a slit or hole which opens upon application of sucking forces thereupon. The nipple has a narrow neck portion disposed near the flared flange and between the flared flange and the permeable portion. The permeable portion and the neck portion pass through the opening defined in the end wall and extend outwardly from the cavity.

The main body further defines means for mating with the securing means. The mating means preferably includes a mating flange disposed on one end of the main body at an exterior surface of the side wall. The mating flange extends around the entire circumference except for one discontinuous portion which forms a gap therethrough. The mating flange gap is configured to allow passage thereby of only the one solitary boss disposed on one side of the inside of the elongated cover. The cover is attachable to the main body only by a tilt, snap and a twist motion requiring prior alignment of the one solitary boss with the gap in the mating flange of the main body during the snap portion of the motion.

The mating flange is disposed on the end of the main body through which the nipple protrudes. A ring flange is disposed similar to the mating flange on the opposite end of the main body for purposes of securing a ring handle to the main body. The ring handle is formed as two rings that are normal to one another. One of the rings serves as a handle for the pacifier, and the other ring serves as the means of attaching the handle to the main body of the pacifier. The attaching ring is expandable to slip over the ring flange and contract around the main body of the pacifier.

The main body further defines a shield extending outwardly from a central region of the exterior surface of the side wall. The shield preferably extends a greater distance in one direction than in a direction transverse to this one direction and curves toward the end wall in the main body. Preferably the shield further defines at least two safety holes located in the portion of the shield that extends a greater distance in one direction than in a direction transverse to the one direction.

The improved pacifier further includes a sealing plug defining a shaft with a bulb at one end and a sealing cap at the other end. The sealing cap extends radially from the longitudinal axis of the shaft. The bulb has a base integral with and wider than the shaft, the base forming a ridge at the wider portion of the base. The shaft is configured and dimensioned approximately equal to the opening in the end wall. The bulb at one end of the sealing plug is preferably frustoconical, and the shaft of the sealing plug is preferably hollow. The bulb passes through the opening and into the nipple past the flared flange portion of the nipple and wedges the neck portion of the nipple between the ridge and the opening in the end wall. The flared flange of the nipple is on the opposite side of the end wall as the neck portion of the nipple. The sealing cap of the sealing plug is configured and dimensioned to engage the sealing ledge at the second end of the main body cavity.

The accompanying drawings, which are incorporated in and constitute a part of this specification, illustrate embodiments of the invention and together with the description serve to explain the principles of the invention.

DESCRIPTION OF THE PREFERRED EMBODIMENTS

Figure 1:
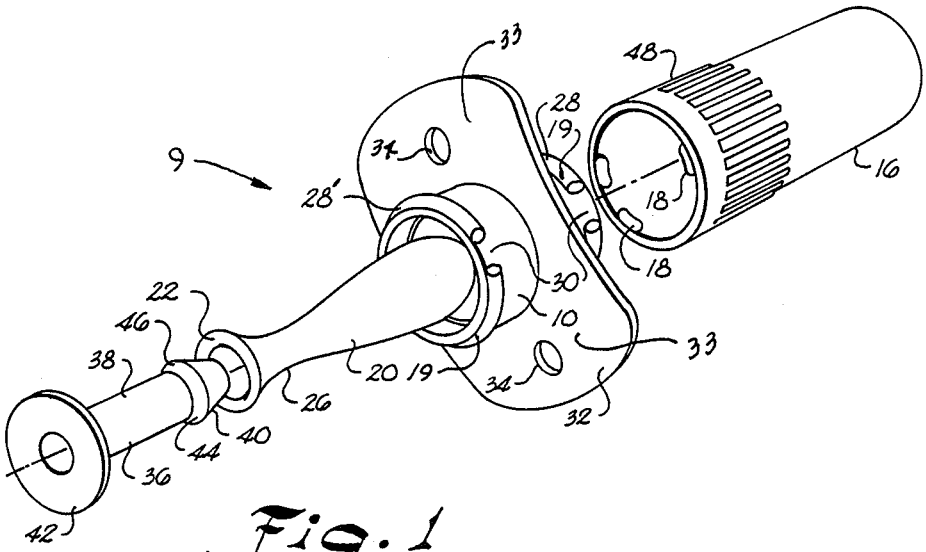
FIG. 1 is a perspective view of an embodiment of the present invention with the ring handle removed for the sake of clarity.

Reference now will be made in detail to the present preferred embodiments of the invention, examples of which are illustrated in the accompanying drawings. A preferred embodiment of the present invention is illustrated in FIG. 1 and designated generally by the numeral 9. An improved baby pacifier with a reuseable, refillable nipple and a cover is illustrated in FIG. 1.

Figure 2:
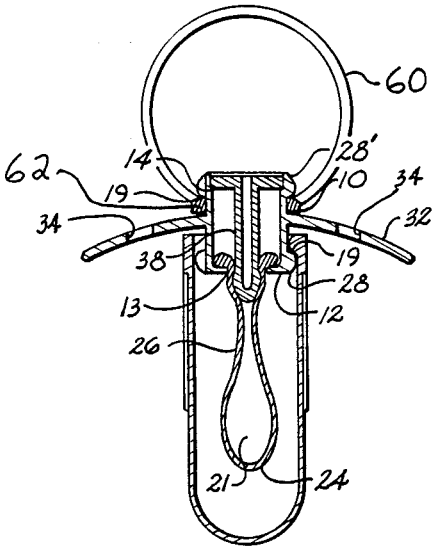
FIG. 2 is a section taken along the longitudinal center line of a view similar to FIG. 1, but with the ring handle added.

As shown in FIGS. 1 and 2 for example, the pacifier of the present invention includes a main body 10. The main body preferably has an integral side wall whose interior surface defines a cavity. The cavity has a first opening at one end and a second opening at a second end disposed opposite the first end. As best illustrated in FIG. 2, the main body defines an end wall 12 at the one end. End wall 12 defines the first opening 13. As best illustrated in FIG. 2, the interior surface of the side wall defines a sealing ledge 14 at the second opening, which is formed in the second end of the cavity.

As best illustrated in FIG. 1, the improved pacifier includes a hollow elongated cover 16, which preferably is open at only on end. Cover 16 further includes gripping ribs 48 located on the exterior surface of the cover and adapted to allow a more secure grasp of the cover.

Figure 4:
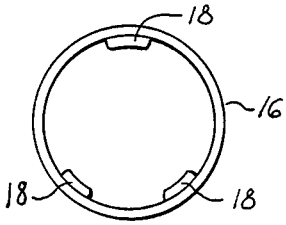
FIG. 4 is a section taken at the open end of the cover member.

In accordance with the present invention, means are provided for securing the cover to the main body. As embodied herein and shown in FIGS. 1 and 4 for example, the securing means can include at least three connecting bosses 18 disposed inside the cover at the open end. One of bosses 18 is disposed generally opposite all other bosses 18, which are generally grouped together. This arrangement of a solitary boss 18 and an oppositely disposed group of bosses 18 ensures a unique way of attachment which is explained more fully below. As embodied herein and shown for example in FIGS. 1 and 4, bosses 18 preferably project from the inside surface of cover 16.

In an alternative embodiment of the securing means, the group of bosses can be replaced by a single boss that is larger than the solitary boss. This larger boss is configured so as not to be able to pass through a gap 30, which is described more fully below.

Figure 3:
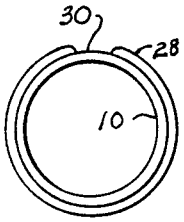
FIG. 3 is a section taken through the mating flange near one of the edges of the central main body portion.

In further accordance with the present invention, means are provided for mating with the securing means of the cover. As embodied herein and shown in FIGS. 1, 2, and 3 for example, the mating means preferably includes a mating flange 28 defined in main body 10. Mating flange 28 is disposed on one end of main body 10 at an exterior surface of the side wall, preferably near the first opening. Flange 28 extends around the entire circumference of the side wall except for one discontinuous portion which forms a gap 30, which is configured to allow passage thereby of only one boss 18 disposed on one side of the inside of elongated cover 16.

Cover 16 is attachable to the main body 10 only by a tilt, snap and twist motion. This motion requires prior alignment of the solitary one of bosses 18 with gap 30 in mating flange 28 of the main body during the snap portion of the motion. After this alignment, the cover is tilted to engage the remaining group of nonaligned bosses 18 with the underside portion 19 (FIGS. 1 and 2) of mating flange 28. Then cover 16 is tilted to push the aligned solitary boss 18 through aligned gap 30 in mating flange 28. Whereupon cover 16 is twisted to misalign solitary boss 18 with gap 30 in mating flange 28. Only alignment of the solitary boss 18 with gap 30 will permit cover 16 to be tilted away from main body 20 and detached therefrom. This improved means for securing the cover to the main body makes it more difficult for the cover to inadvertently come off and also makes it difficult for a child to remove the cover. The improved means for securing the cover operates such that a child must first align the solitary boss with the gap, and then tilt the cover in the correct direction to get the cover off. This would be more difficult for a child to accomplish than merely to unscrew the cover as in the conventional pacifier.

Cover 16 is attached to the main body on the same end of the main body as end wall 12, and serves as a cover to protect a nipple 20 (described below). The improved means for securing the cover to the main body reduces the likelihood that a child could remove the cover, and this is an advantage in households having small children in addition to an infant.

A ring flange 28′ is disposed on the end of the main body opposite the end through which the nipple protrudes. As shown in FIG. 2, ring flange 28′ can be similar to the mating flange, but preferably is continuous rather than with a gap as shown in FIG. 1. Ring flange 28' is disposed on the opposite end of the main body for purposes of securing a ring handle 60 to the main body. The ring handle is formed as two rings that are normal to one another. One of the rings is a ring handle 60, which serves as a handle for the pacifier. The other ring is an attaching ring 62, which serves as the means of attaching the handle to the main body of the pacifier. The attaching ring 62 is expandable to slip over ring flange 28' and contract around main body 10 of the pacifier. Attaching ring 62 and ring handle 60 preferably are integrally formed of an elastic material suitable for use in baby pacifiers.

In accordance with the improved pacifier of the present invention, means are provided for the baby to suck. As embodied herein and shown in FIGS. 1 and 2 for example, the means for the baby to suck preferably includes a hollow flexible nipple 20. Nipple 20 is open at only one end into a receiving cavity 21 and forms a flared flange 22 at the open end. As best illustrated in FIG. 2, the nipple preferably has a liquid permeable portion 24 disposed opposite the open end. Preferably, the permeable portion defines a slit or hole which opens upon application of sucking forces thereupon. This permeable portion is conventional and as such is not specifically illustrated in the drawings. As shown in FIGS. 1 and 2, nipple 20 preferably has a narrow neck portion 26 disposed near flared flange 22 and between flared flange 22 and permeable portion 24. As best illustrated in FIG. 2, permeable portion 24 and neck portion 26 pass through opening 13 defined in end wall 12 and extend outwardly from the cavity.

As illustrated in FIGS. 1 and 2, a sealing plug 36 is adapted to secure nipple 20 to main body 10. Sealing plug 36 defines a hollow shaft 38 with a frustoconical bulb 40 at one end and a sealing cap 42 at the other end. Cap 42 extends radially from the longitudinal axis of the shaft opposite the end carrying bulb 40. Bulb 40 has a base 44 integral with and wider than shaft 38. The base forms a ridge 46 at the wider portion of the base. Shaft 38 is configured and dimensioned approximately equal to opening 13 in end wall 12. Bulb 40 passes through opening 13 in end wall 12 and into nipple 20 past flared flange portion 22 of nipple 20 and wedges neck portion 26 of nipple 20 between ridge 46 and opening 13 in end wall 12. Flared flange 22 of nipple 20 is on the opposite side of the end wall as neck portion 26 of the nipple. Sealing cap 42 of sealing plug 36 is configured and dimensioned to engage sealing ledge 14 at the second end of the main body cavity.

Bulb 40 of sealing plug 36 serves to seal any substance with which the nipple cavity has been filled, from leaking out of the nipple prior to sucking by the baby. A desirable filling substance such as fruit juice, soft drink or formula can be used to fill the nipple cavity. The baby can withdraw this filling substance by sucking it through permeable portion 24. It is intended that the nipple can be reused once it is emptied. One merely presses one's finger against bulb 40 to disengage it and sealing cap 42 from main body 10 to release nipple 20. Whereupon nipple 20 can be withdrawn and cleansed prior to refilling with the same or another desirable filling substance. For example, doses of liquified medicine or treats can be stored in the nipples of a number of pacifiers which have been prepared in advance for use when the baby is traveling on a trip. The cover helps to keep the nipple clean while the pacifier is being stored prior to use.

As illustrated in FIGS. 1 and 2 for example, main body 10 further defines a shield 32 extending outwardly from a central region of the exterior surface of the side wall. Shield 32 extends a greater distance in one direction than in a direction transverse to this one direction and forms a wing portion 33 disposed on each opposite side of main body 10. As best illustrated in FIG. 2, shield 32 preferably curves towards end wall 12. In curving towards the nipple extending from end wall 12, the curvature of the shield is adapted to make it more difficult for a child to swallow the pacifier.

The shield 32 preferably defines at least two safety holes 34. Each safety hole 34 is preferably located in one of wing portions 33 of the shield. Safety holes 34 in shield 32 are adapted to allow air passage to the child's lungs in the unlikely event that the pacifier is swallowed and becomes lodged in the child's throat.

In accordance with the present invention, the improved baby pacifier may be constructed of any material suitable for use as a baby pacifier.

It will be apparent to those skilled in the art that various modifications and variations can be made in the improved baby pacifier of the present invention without departing from the scope or spirit of the invention. Thus, it is intended that the present invention cover the modifications and variations of this invention provided they come within the scope of the appended claims and their equivalents.

What is claimed is:

1. An improved baby pacifier, comprising:

(a) a main body having an integral side wall, said side wall having an interior surface defining a cavity, said cavity having a first opening at one end thereof and a second opening at a second end disposed opposite said one end, said main body defining an end wall at said one end, said end wall defining an opening therethrough, said interior surface of said side wall defining a sealing ledge at said second end of said cavity;

(b) a hollow elongated cover open at only one end thereof, said cover having means for securing said cover to said main body, said securing means including at least three bosses disposed inside said cover at said open end, one of said bosses being a solitary boss disposed generally opposite all the rest of said bosses;

(c) means for the baby to suck, said sucking means including a hollow flexible nipple defining a receiving cavity, said nipple being open at only one end into said nipple receiving cavity and forming a flared flange at said open end and having a liquid permeable portion disposed opposite said open end, said nipple having a narrow neck portion disposed near said flared flange and between said flared flange and said permeable portion, said permeable portion and said neck portion passing through said opening defined in said end wall and extending outwardly from said main body cavity;

(d) said main body defining means for mating with said securing means, said mating means including a mating flange disposed on the end of said main body near said end wall and at an exterior surface of said side wall, said mating flange having a gap formed therethrough, said gap being configured to allow passage thereby of only said one solitary boss disposed on one side of said inside of said elongated cover;

(e) a handle defining a ring handle disposed in a plane and an expandable attaching ring connected thereto and being disposed in a plane normal to the plane defining said ring handle;

(f) said main body defining means for attaching said attaching ring, said attaching means including a ring flange disposed on the end of said main body opposite the end near said end wall and at an exterior surface of said wall, said ring flange being configured to permit said attaching ring to expand sufficiently to pass over said ring flange and thereafter contract around said main body to secure said handle to said main body;

(g) said main body further defining a shield extending outwardly from a central region of said exterior surface of said side wall;

(h) a sealing plug defining a shaft with a bulb at one end and a sealing cap at an end opposite one end, said sealing cap extending radially from the longitudinal axis of said shaft, said bulb having a base integral with and wider than said shaft, said base forming a ridge at said wider portion of said base, said shaft being configured and dimensioned approximately equal to said opening in said end wall, said bulb passing through said end wall opening and into said nipple past said flared flange portion of said nipple and wedging said neck portion of said nipple between said ridge and said opening in said end wall, said flared flange being on the opposite side of said end wall as said neck portion of said nipple, said sealing cap being configured and dimensioned to engage said sealing ledge at said second end of said main body cavity; and (i) said cover being attachable to said main body only by a tilt, snap and twist motion requiring prior alignment of said solitary one of said bosses with said gap in said mating flange of said main body during said snap portion of said motion.

2. An improved baby pacifier as defined in claim 1, wherein said shield extends a greater distance in one direction than in a direction transverse to said one direction and forms two wing portions, one wing portion being disposed generally on one side of said main body and said other wing portion being disposed on the opposite side of said main body.

3. An improved baby pacifier as defined in claim 2, wherein said shield curves toward said end wall.

4. An improved baby pacifier as defined in claim 2, wherein said shield defines at least two safety holes, one of said safety holes being located in one of said wing portions of said shield.

5. An improved baby pacifier as defined in claim 1, wherein said shaft is hollow and said bulb is frustoconical.

6. An improved baby pacifier, comprising:

(a) a main body having an integral side wall, said side wall having an interior surface defining a cavity, said cavity having a first opening at one end thereof and a second opening at a second end disposed opposite said one end, said main body defining an end wall at said one end, said end wall defining an opening therethrough, said interior surface of said side wall defining a sealing ledge at said second end of said cavity;

(b) a hollow elongated cover open at only one end thereof, said cover having at least three bosses disposed inside said cover at said open end, one of said bosses being a solitary boss disposed generally opposite all the rest of said bosses;

(c) a hollow flexible nipple defining a receiving cavity, said nipple being open at only one end into said nipple receiving cavity and forming a flared flange at said open end and having a liquid permeable portion disposed opposite said open end, said nipple having a narrow neck portion disposed near said flared flange and between said flared flange and said permeable portion, said permeable portion and said neck portion passing through said opening defined in said end wall and extending outwardly from said main body cavity;

(d) said main body defining a mating flange disposed on one end of said main body near said end wall at an exterior surface of said side wall, said mating flange having a gap formed therethrough, said gap being configured to allow passage thereby of only said one solitary boss disposed on one side of said inside of said elongated cover;

(e) a handle defining a ring handle disposed in a plane and an expandable attaching ring connected thereto and being disposed in a plane normal to the plane defining said ring handle;

(f) said main body defining means for attaching said attaching ring, said attaching means including a ring flange disposed on the end of said main body opposite the end near said end wall and at an exterior surface of said side wall, said ring flange being configured to permit said attaching ring to expand sufficiently to pass over said ring flange and thereafter contract around said main body to secure said handle to said main body;

(g) said main body further defining a shield extending outwardly from a central region of said exterior surface of said side wall, said shield extending a greater distance in one direction than in a direction transverse to said one direction, said shield curving toward said end wall;

(h) a sealing plug defining a hollow shaft with a frustoconical bulb at one end and a cap at an end opposite said one end of said plug, said cap extending radially from the longitudinal axis of said shaft, said bulb having a base integral with and wider than said shaft, said base forming a ridge at said wider portion of said base, said shaft being configured and dimensioned approximately equal to said opening in said end wall, said bulb passing through said end wall opening and into said nipple past said flared flange portion of said nipple and wedging said neck portion of said nipple between said ridge and said opening in said end wall, said flared flange of said nipple being on the opposite side of said end wall as said neck portion of said nipple, said cap of said sealing plug being configured and dimensioned to engage said sealing ledge at said second end of the main body cavity; and (i) said cover being attachable to said main body only by a tilt, snap and twist motion requiring prior alignment of said solitary one of said bosses with said gap in said mating flange of said main body during said snap portion of said motion.

7. An improved baby pacifier, comprising:

(a) a main body having an integral side wall, said side wall having an interior surface defining a cavity, said cavity having a first opening at one end thereof and a second opening at a second end disposed opposite said one end, said main body defining an end wall at said one end, said end wall defining an opening therethrough, said interior surface of said side wall defining a sealing ledge at said second end of said cavity;

(b) a hollow elongated cover open at only one end thereof, said cover having at least three bosses disposed inside said cover at said open end, all but one of said bosses being disposed generally near each other, said one of said bosses being a solitary boss disposed generally opposite the rest of said bosses;

(c) a hollow flexible nipple defining a receiving cavity, said nipple being open at only one end into said nipple receiving cavity and forming a flared flange at said open end and having a liquid permeable portion disposed opposite said open end, said nipple having a narrow neck portion disposed near said flared flange and between said flared flange and said permeable portion, said permeable portion and said neck portion passing through said opening defined in said end wall and extending outwardly from said main body cavity;

(d) said main body defining a mating flange disposed on one end of said main body near said end wall at an exterior surface of said side wall, said mating flange having a gap formed therethrough, said gap being configured to allow passage thereby of only one of said bosses disposed on one side of said inside of said elongated cover;

(e) a handle defining a ring handle disposed in a plane and an expandable attaching ring connected thereto and being disposed in a plane normal to the plane defining said ring handle;

(f) said main body defining means for attaching said attaching ring, said attaching means including a ring flange disposed on the end of said main body opposite the end near said end wall and at an exterior surface of said side wall, said ring flange being configured to permit said attaching ring to expand sufficiently to pass over said ring flange and thereafter contract around said main body to secure said handle to said main body;

(g) said main body further defining a shield extending outwardly from a central region of said exterior surface of said side wall, said shield extending a greater distance in one direction than in a direction transverse to said one direction, said shield curving toward said end wall, said shield defining at least two safety holes located in the portion of said shield that extends a greater distance in one direction than in a direction transverse to said one direction;

(h) a sealing plug defining a hollow shaft with a frustoconical bulb at one end and a cap at the end opposite said one end, said cap extending radially from the longitudinal axis of said shaft, said bulb having a base integral with and wider than said shaft, said base forming a ridge at said wider portion of said base, said shaft being configured and dimensioned approximately equal to said opening in said end wall, said bulb passing through said end wall opening and into said nipple past said flared flange portion of said nipple and wedging said nipple between said ridge and said opening in said end wall, said flared flange of said nipple being on the opposite side of said end wall as said neck portion of said nipple, said flared flange of said sealing plug being configured and dimensioned to engage said sealing ledge at said second end of said main body cavity; and (i) said cover being attachable to said main body only by a tilt, snap and twist motion requiring prior alignment of said solitary boss with said gap in said mating flange of said main body during said snap portion of said motion.

* * * * *